United States Patent [19]

Gattyan

[11] 4,188,873

[45] Feb. 19, 1980

[54] PISTON/CYLINDER TYPE ELEMENTS AND COMPACTORS EMBODYING THOSE ELEMENTS

[76] Inventor: Andor Gattyan, 242 Nelson Rd., Scarsdale, N.Y. 10583

[21] Appl. No.: 851,017

[22] Filed: Nov. 14, 1977

Related U.S. Application Data

[62] Division of Ser. No. 766,405, Feb. 7, 1977.

[51] Int. Cl.[2] ..... B30B 15/08

[52] U.S. Cl. ..... 100/98 R; 100/179

[58] Field of Search ..... 100/98 R, 179, DIG. 3, 100/DIG. 5, DIG. 8; 425/190, 192

[56] References Cited

U.S. PATENT DOCUMENTS

| | | | |
|---|---|---|---|
| 146,076 | 12/1873 | Kaskel | 425/192 |
| 2,770,836 | 11/1956 | Hankey | 425/190 |
| 3,386,131 | 6/1968 | Vanzo | 425/190 |
| 3,802,337 | 4/1974 | St.-Hilaire | 100/98 R |

FOREIGN PATENT DOCUMENTS

| | | | |
|---|---|---|---|
| 268977 | 4/1927 | United Kingdom | 425/191 |

*Primary Examiner*—Billy J. Wilhite

*Attorney, Agent, or Firm*—Albert C. Nolte, Jr.; Edward B. Hunter

[57] ABSTRACT

A piston/cylinder type element particularly suited for embodiment in a refuse compactor as the ram thereof comprises adjustable guide means for guiding the piston-like element in sliding movement within the cylinder. The guide means are adjustable to accommodate wear in the mating surfaces thereof. There is also disclosed a discharge cone for a compactor which is releasably secured to the ramhousing structure in a selected one of a plurality of positions evenly to distribute wear on the cone produced by the passage of refuse therethrough and that cone is removable from the ram housing to be replaced by a different structure, depending upon the refuse to be compacted. Additionally, the ram member of a compactor includes novel teeth elements to cut through refuse which might otherwise be wedged between adjacent surfaces of the ram and cylinder and cause jamming.

5 Claims, 9 Drawing Figures

FIG. 2
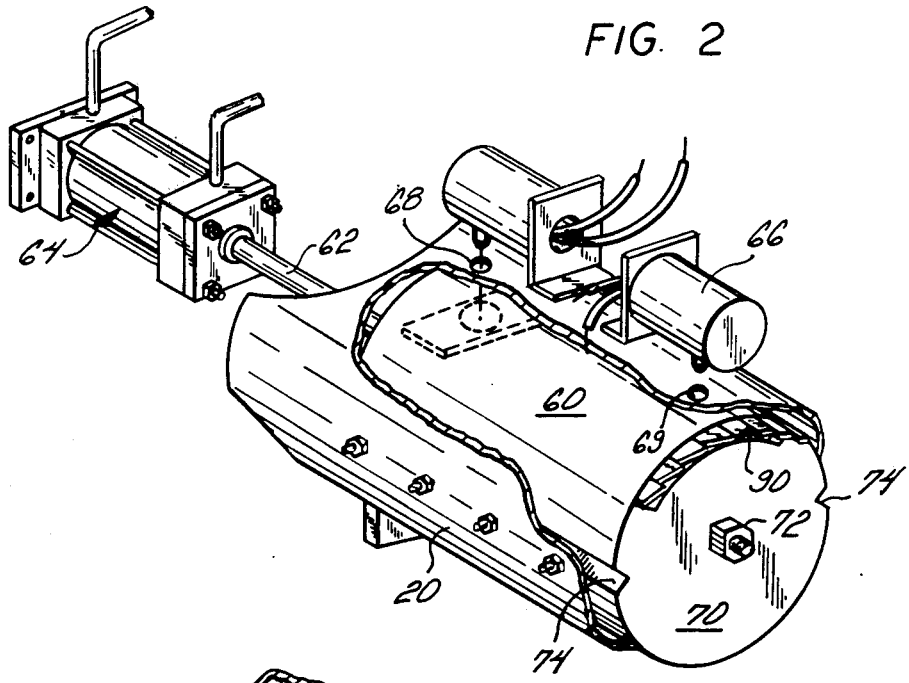
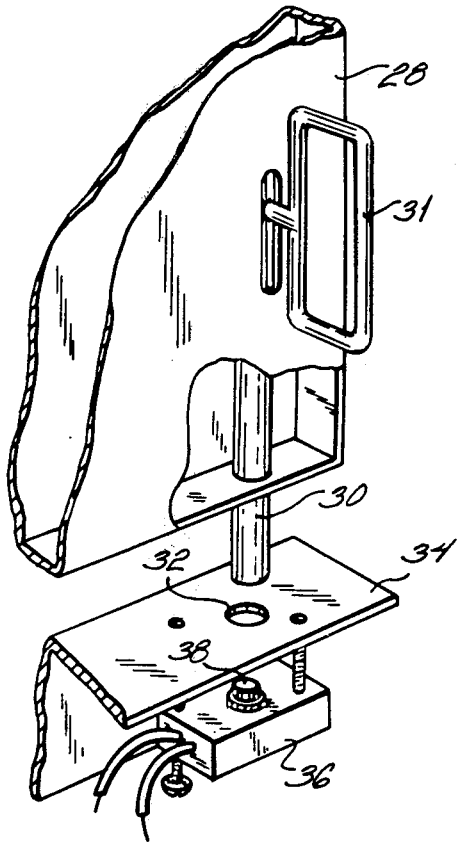
FIG. 3

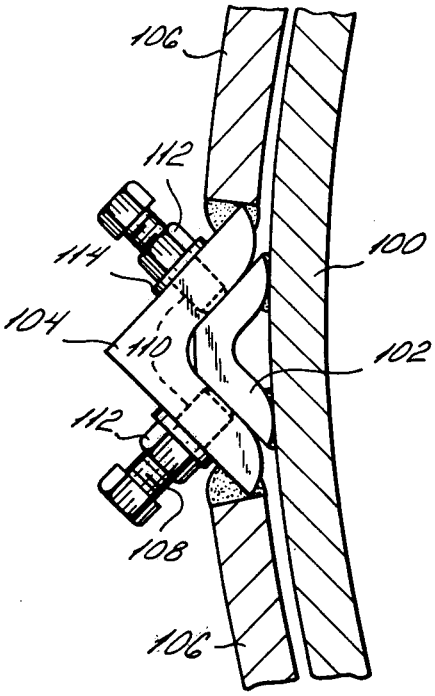
FIG. 7
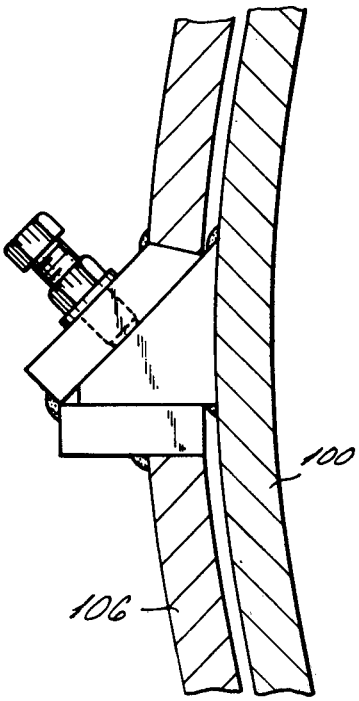
FIG. 8
FIG. 9
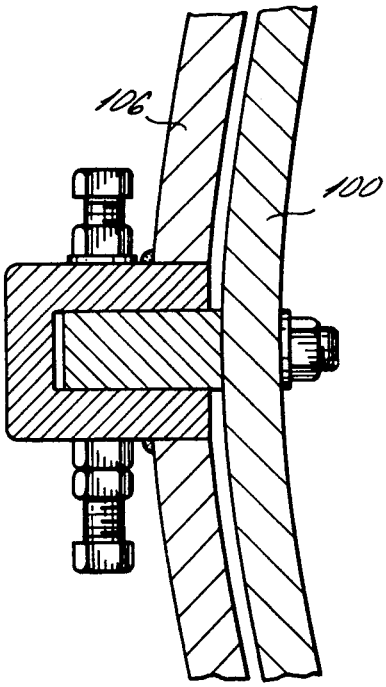

PISTON/CYLINDER TYPE ELEMENTS AND COMPACTORS EMBODYING THOSE ELEMENTS

This is a divisional of copending application Ser. No. 766,405 filed Feb. 7, 1977.

BACKGROUND OF THE INVENTION

This invention is concerned with piston/cylinder-like elements and is particularly concerned with such elements when embodied as the ram of a refuse compactor, although it is to be appreciated that it may find application in other environments, as, for example, in a reciprocating piston internal combustion engine.

In the interests of brevity, this aspect of the invention will be described with particular reference to its application in a refuse compactor. It is known in refuse compactors to provide an hydraulically operated ram within a cooperating cylinder into which refuse to be compacted is delivered. Because of the variations in the densities of the refuse and the differences in resistance to compacting of the components of the refuse, substantial non-axial forces are generated during the operation of the ram. To alleviate this problem, it has been proposed to provide guide rail and follower means on the ram and cylinder, respectively, those elements being effective to resist the non-axial forces. The problem arises that wear occurs on the guide elements with continued use and with that wear the continued rate of deterioration of the guide elements is increased, requiring a replacement of at least the guide elements and in some instances of the ram and cylinder. The present invention seeks to overcome this disadvantage.

Another problem which occurs in a refuse compactor is that wear on the discharge tube or cone is localized at the bottom of that cone or tube and the durability of the tube is not all that might be hoped for.

A further disadvantage with garbage compactors is that frequently there occurs a jamming of the ram within the cylinder, where components of the refuse may become jammed between the leading edge of the ram and the opening of the cylinder through which the refuse is delivered. It has been proposed to provide cutting elements in this region of the ram and the present invention seeks to provide an improved cutting structure.

BRIEF SUMMARY OF THE INVENTION

According to one aspect of this invention, there is provided piston and cylinder elements of which one has a longitudinally extending track and the other cooperating follower means. One of the track and follower means is adjustable radially of the cylinder and the two elements are so configured that when wear between cooperating surfaces of the elements produces an increased clearance, an effective guiding relationship can be re-established between those elements by making a radial adjustment of the adjustable one of those elements.

According to another aspect of the present invention, there is provided a compactor having a ram and cylinder of which the discharge end of the cylinder has a separable discharge tube connected to it, that tube most desirably being of frustoconical form and being connected to the cylinder element at a circular section thereof by means which allow the discharge tube to be removed and replaced in a different angular position relatively to the cylinder so that wear may be equalized about the periphery of the discharge tube.

According to yet another aspect of the present invention, the ram of a compactor is provided at that edge which traverses the opening to the cylinder through which refuse to be compacted passes with cutting teeth adjacent cutting edges of which are separated by shoulders which extend in a direction substantially parallel to the axis of the ram.

BRIEF DESCRIPTION OF THE DRAWINGS

An embodiment of the invention is illustrated schematically, in the accompanying drawings, in which:

FIG. 2 is a further isometric view of the structure of FIG. 1, with certain parts removed in the interests of clarity;

FIG. 3 is an isometric view of the detail of the structure of FIG. 1;

FIGS. 7, 8 and 9 are part cross sectional views of details of alternative embodiments of the invention.

DESCRIPTION OF THE PREFERRED EMBODIMENTS

Figure 1:
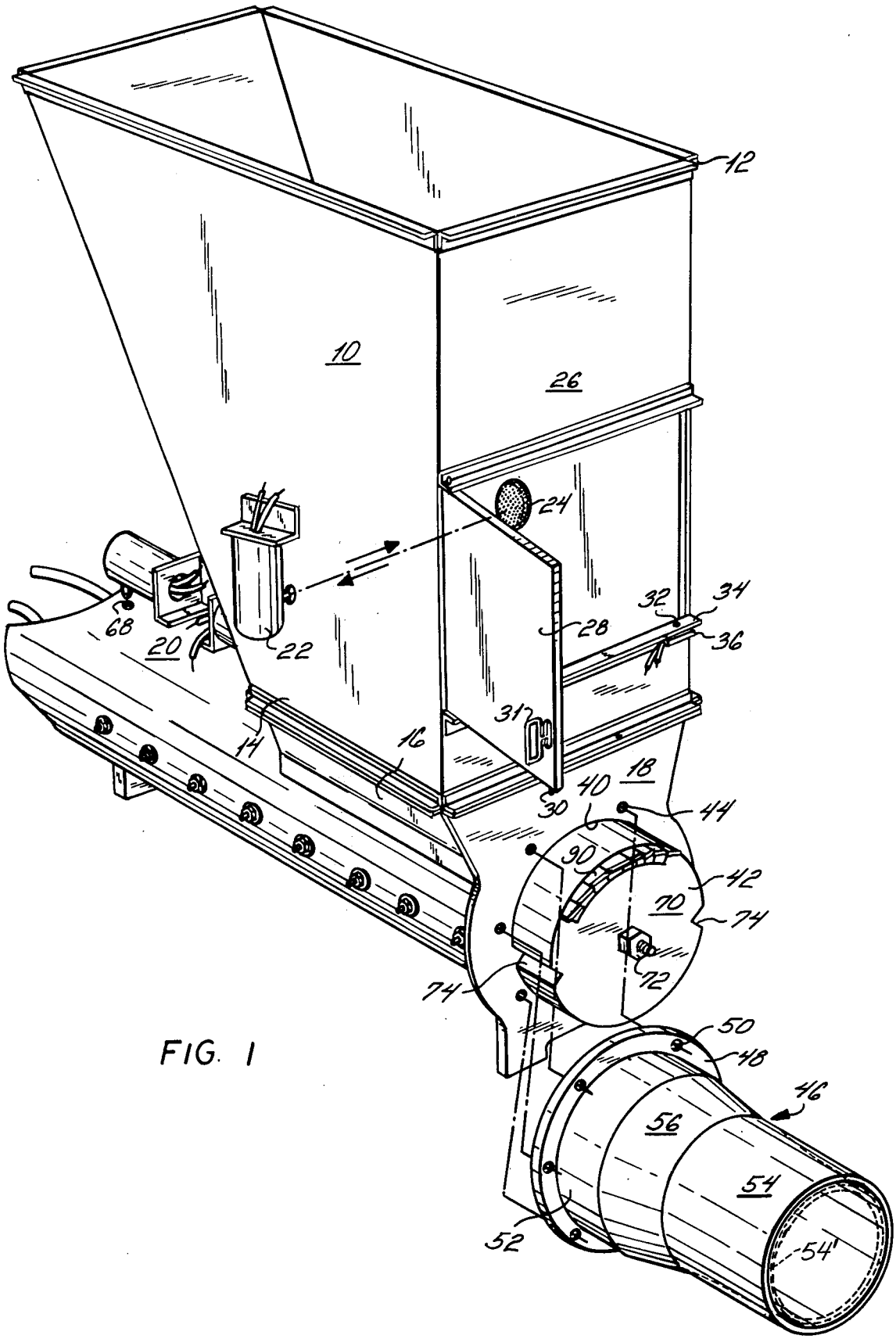
FIG. 1 is an isometric view of a compactor of the present invention.

The structure in the drawings comprises a hopper or chute element generally indicated at 10 and which has at its upper edge flange means 12 by which it is connectable to a delivery system as, for example, a garbage chute in an apartment dwelling. The hopper 10 tapers towards its lower end 14 at which it is provided with a flange structure by which it is connectable to ram housing elements 16 and 18. The chute obviously is open at its lower end and communicates with an opening in cylinder 20 so that refuse falling through the chute can enter the interior of the cylinder. Illustrated schematically in the drawings is control apparatus comprising a light source and photocell element 22 at one side of the chute with a reflector element 24 disposed on the opposite sides of the chute so that refuse falling through the chute will interrupt the light beam and cause a signal to be transmitted to activate the ram. Since the control mechanism may take any of the well-known forms, the particular structure herein is not described in detail.

A front wall 26 of the chute 10 is provided with a door 28 by which access may be had to the ram and that door includes, as can be seen in FIG. 3 in greater detail, a latch structure 30 with an operating handle 32, the latch being engagable in a hole 32 formed in a frame element 34 which constitutes a keeper. Disposed in alignment with hole 32 is an electrical switch 36, the operating element 38 of which is adapted to be engaged by latch 30. The switch is arranged in a circuit so that only when the latch is engaged in opening 32 to close the door 28 is the switch actuated to complete a circuit which will allow the ram to be operated.

The ram housing structure 18 constitutes a front plate with a central opening 40 through which ram 42 projects and formed in that front plate 18 are a plurality of holes 44 disposed about central opening 40, those openings constituting means by which a discharge tube or cone 46 may be secured to front plate 18, the discharge cone having a flange 48 provided with a plurality of holes 50 registrable with holes 44 of the front plate. The holes are so spaced that the angular position of the discharge cone may be changed as desired to equalize wear about the circumference of the cone.

The cone comprises a first cylindrical section 52 and a terminal cylindrical section 54, those two sections being interconnected by a frustoconical portion 56. By carefully selecting the cone angle and the diameters of sections 52 and 54 the degree of compaction or the compactor ratio of refuse can be controlled. For instance, the cone angle of the terminal section 54' shown in dotted lines in FIG. 1 is smaller than the full line cone 54 and will provide a greater degree of compaction.

Figure 6:
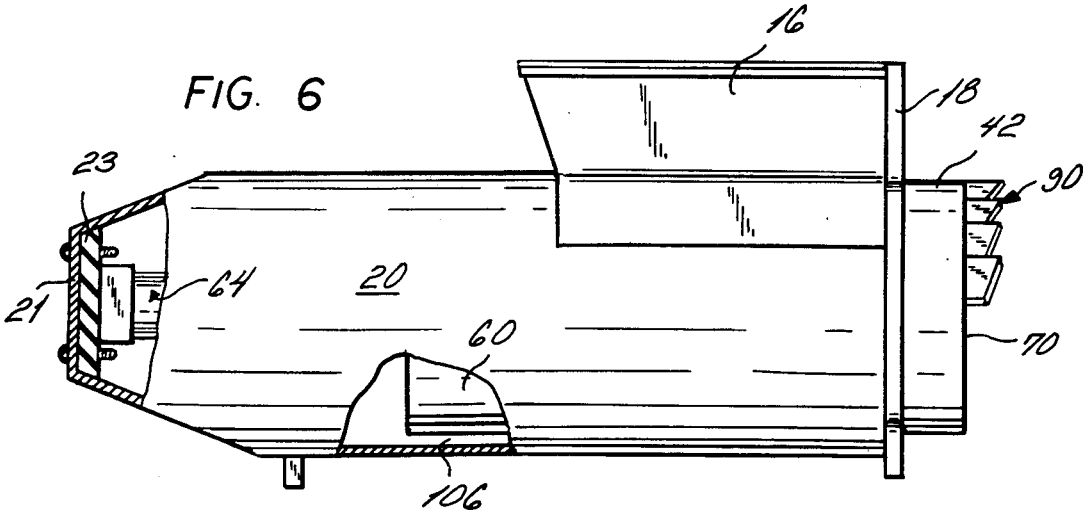
FIG. 6 is a side view of the compactor of FIG. 1 partly broken away.

Ram 42 is disposed within the cylinder 20 and is connected to piston rod 62 of double acting piston/cylinder unit 64. As can be seen in FIG. 6, there is a space between adjacent surfaces of the ram and cylinder. Mounted on the cylinder 20 are a pair of control elements 66 which comprise light sources and photocells and which, through openings 68 and 69 detect the position of ram 60 and generate signals to effect a control of piston/cylinder unit 64 and hence of ram 42. It is to be understood, however, that a variety of different control techniques are available for use with the present invention. However, the control claimed above eliminates two to five mechanical elements utilized in conventional compactor controls and which are a frequent cause of breakdown.

The leading end of the piston rod 62 is secured to front face 70 of ram 42 by nut means 72 and the cylinder of the piston/cylinder unit 64 is connected to a structural element 21 of the compactor through the intermediary of a shock absorbing block 23 of, for example, rubber.

Figure 4:
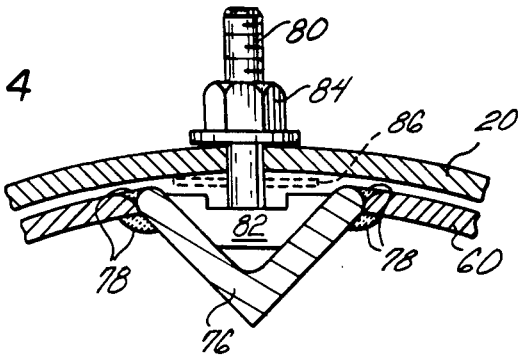
FIG. 4 is a cross-sectional view of the detail of the structure of FIG. 1.

A pair of axially extending V-sectioned grooves 74 are formed at diametrically opposed locations on the outer surface of ram 60, those grooves being defined, as may be seen particularly in FIG. 4, by an angle iron element 76 secured, as by welding at 78, within an axial slot cut in the cylindrical wall of the ram.

Secured to the interior of cylinder 20 by means of stud elements 80, seen particularly in FIG. 4, are track follower means 82 having track engaging faces including an angle similar to the angle of the angle iron, in the particular embodiment illustrated, that angle being 90°. The follower elements 82 are held in position by nuts 84 on studs 80. The radial position of the follower elements 82 is adjustable by the insertion of shim elements, one of which is shown in dotted line at 86 in FIG. 4. It will be appreciated that the male to female cooperating relationship between the angle 76 and the follower 82 is effective to guide the ram for axial sliding movement within the cylinder 20 and to absorb non-axial forces. It will also be appreciated that as the cooperating surfaces of the follower and angle 76 wear, the guiding relationship can be restored by adjusting the radial position of follower 82.

Figure 5:
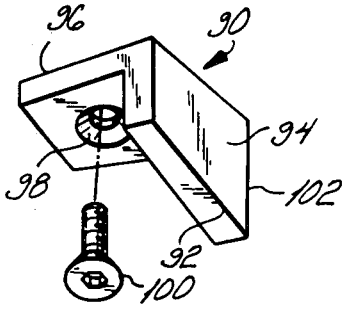
FIG. 5 is an isometric view of a component of the embodiment of FIG. 1.

At the upper circumference of the front face 70 of the ram there are formed a plurality of teeth 90 one of which is illustrated in FIG. 5 and which comprises a cutting edge 92 formed on one limb 94 of a generally L-shaped body, the other limb 96 of which is provided with an opening 98 through which screw 100 is passed to be engaged in an appropriately threaded hole of the front of the ram to secure the tooth in position. The cutting edge 92 is disposed to include an angle of approximately 5° to the plane of the front face of the ram so that as the teeth cross the adjacent surface of the front plate 18, a shearing action is effected on refuse between the cutting edge and the aforementioned adjacent edge of plate 18. It is to be noted that the edge 102 of the tooth element is axial and it will be clear from a consideration of FIG. 2 that the teeth to opposite sides of a vertical center line of the ram are of opposite hands. In the past it has been proposed that double-edged teeth elements of generally V-like section be utilized, however, it has been found that the arrangement illustrated herein is more effective in precluding jamming which might otherwise occur when a piece of refuse resistant to shearing becomes wedged between the adjacent edges of the ram and plate 18.

In an alternative embodiment of the invention illustrated in FIG. 7, there is secured to the outer cylindrical surface of ram 100 an angle iron 102. A similar angle iron is disposed on the ram at a location spaced 180° from angle 102.

Iron 102 projects into a correspondingly shaped angle iron 104 secured by welding to cylinder or housing 106, angle 104 constituting a support for adjustment bolts 108 the forward ends of which abut the outer surfaces of angle 102 to guide the ram 102 for sliding movement within the housing. The bolts 108 are received within screw threaded openings 110 of the limbs of angle 104 and are each provided with a locking nut 112 and a washer 114 effective to lock them in a desired position. As wear increases the clearance between the forward or leading ends of the bolts and the outer surfaces of the limbs of the angle 102, an adjustment of the positions of the bolts is made to ensure effective guidance of the ram.

It will be recognized that the invention is subject to variations which do not deviate from its scope.

In the particular embodiment of the invention illustrated in FIGS. 1 through 6, the utilization of a 90° angle iron has been shown for the track structure of the ram, but of course it will be recognized that the primary requirement of the track means is such that after wear occurs, readjustment of the radial spacing of the follower and track should restore the guiding relationship of the cooperating surfaces of those two elements. Thus, it is possible to use an angle iron other than 90°, for example, one may use a 30° or 45° angle as shown in FIG. 8. As a further alternative, one may use a rectangular sectioned follower in place of the angle 102 of FIG. 7, that follower being received within a correspondingly shaped female track structure having aligned guide bolts engaging opposed surfaces of the follower, this as shown in FIG. 9.

Further, the arrangement illustrated in FIGS. 1 through 6 is one in which the follower and the track have a male to female relationship, but clearly that relationship could be reversed as shown, for example, in FIG. 7.

Additionally, although the track and follower means have been described with particular attention to utilization in a refuse compactor environment, clearly, in any ram/cylinder device, or piston/cylinder device, they would be equally appropriate.

What is claimed is:

1. A garbage compactor comprising a ram mechanism including horizontally operable ram and cylinder elements and hopper means for directing garbage delivered to said hopper means vertically downwardly to the interior of the cylinder element, said cylinder element having a discharge end, a discharge tube secured to said discharge end of the cylinder, said ram element being movable with said cylinder element against the garbage at the upper portions of said ram and of said cylinder at its junction with said hopper means and towards said discharge tube to cause garbage delivered to the interior of the cylinder element to be compacted and to thereby transmit forces effected by said ram moving against the garbage and by the compacting of the garbage to lower portions of said cylinder element and said tube, said tube being of generally circular cross section and substantially coaxial with said cylinder element, and releasable means for disassembling said tube from said cylinder and for securing said tube in a selected one of a plurality of radial angular positions relative to said cylinder, said securing means being thus constituted as means for changing the position of wear about the inner periphery of said tube.

2. Apparatus as claimed in claim 1 wherein said discharge tube includes a frustoconical section a lesser diameter section of which is more remote from the discharge end of the cylinder element than is a greater diameter section thereof.

3. Apparatus as claimed in claim 1 wherein said discharge tube is removably secured to said cylindrical element for replacement and servicing.

4. Apparatus as claimed in claim 1 wherein an edge of a front face of said ram element is provided with teeth each tooth including a cutting edge inclined to said front face, the cutting edges of adjacent teeth being separated by substantially axially extending shoulders.

5. The garbage compactor of claim 1 further comprising a plurality of discharge tubes, each having a frustoconical section and each having means by which it may be releasably connected to the discharge end of said cylinder element in such a manner that a lesser diameter section of the frustoconical section is more remote from the discharge end of the cylinder element than is a greater diameter section thereof, each one of said discharge tubes having a different smallest diameter section than others of said plurality of discharge tubes, a selected one of said discharge tubes being secured to said discharge end of said cylinder element and said remaining ones of said plurality of discharge tubes being available for replacement of said discharge tube connected to said cylinder element, each said discharge tube, when secured to said cylinder element, being constituted as means for achieving a degree of compaction of garbage different than that achieved by the remaining ones of said tubes.

* * * * *